US005616017A

United States Patent [19]

Iizuka et al.

[11] Patent Number: 5,616,017

[45] Date of Patent: Apr. 1, 1997

[54] ROTARY COMPRESSOR HAVING A CYLINDER PORTION FORMED OF A VALVE SHEET

[75] Inventors: Hirokazu Iizuka, Susono; Masashi Ohmura, Fuji; Masataka Kondo, Fuji; Hideki Kobayashi, Fuji; Hiroyuki Mizuno, Fuji; Takaya Yamazaki, Shizuoka; Kazuo Shibata, Fuji, all of Japan

[73] Assignee: Kabushiki Kaisha Toshiba, Kanagana-ken, Japan

[21] Appl. No.: 527,326

[22] Filed: Sep. 12, 1995

[30] Foreign Application Priority Data

Dec. 28, 1994 [JP] Japan ..... 6-327908
Mar. 1, 1995 [JP] Japan ..... 7-042076

[51] Int. Cl.[6] ..... F04C 18/356; F04C 29/00

[52] U.S. Cl. ..... 418/63; 418/152; 418/178; 418/179; 418/270; 137/382

[58] Field of Search ..... 418/63–67, 152, 418/178, 179, 243–251, 270; 137/382

[56] References Cited

U.S. PATENT DOCUMENTS

| | | | |
|---|---|---|---|
| 577,936 | 3/1897 | Verrue | 418/248 |
| 1,603,983 | 10/1926 | Rolaff | 418/63 |
| 1,780,614 | 11/1930 | Bolster | 418/247 |
| 1,901,417 | 3/1933 | Sleeper | 418/65 |
| 4,219,314 | 8/1980 | Haggerty | 418/63 |
| 4,515,513 | 5/1985 | Hayase et al. | 418/178 |
| 4,974,318 | 12/1990 | Heppekausen et al. | 418/178 |

FOREIGN PATENT DOCUMENTS

| | | | |
|---|---|---|---|
| 804023 | 7/1936 | France | 418/63 |
| 1005203 | 12/1951 | France | 418/248 |
| 825692 | 1/1952 | Germany | 418/63 |
| 895298 | 11/1953 | Germany | 418/248 |
| 54-13005 | 1/1979 | Japan | 418/179 |
| 57-206790 | 12/1982 | Japan | 418/63 |
| 58-88487 | 5/1983 | Japan | 418/63 |
| 62-20186 | 2/1987 | Japan . | |
| 63-12894 | 1/1988 | Japan | 418/179 |
| 3260392 | 11/1991 | Japan | 418/63 |
| 5157087 | 6/1993 | Japan | 418/63 |

*Primary Examiner*—John J. Vrablik
*Attorney, Agent, or Firm*—Limbach & Limbach L.L.P.; Ronald L. Yin

[57] ABSTRACT

A rotary compressor comprises an outer casing, a rotary type compression mechanism accommodated in the outer casing in a sealed manner, and an electric motor for driving the rotary type compression mechanism. The rotary type compression mechanism is provided with a cylinder having an inner peripheral surface to which a discharge port is formed, and the inner peripheral surface of the cylinder has a portion formed of a valve sheet to which said discharge port is formed.

17 Claims, 8 Drawing Sheets

ROTARY COMPRESSOR HAVING A CYLINDER PORTION FORMED OF A VALVE SHEET

BACKGROUND OF THE INVENTION

The present invention relates to rotary compressors assembled in refrigerating cycles of various types of refrigerating machines, refrigerators, air conditioners and the like, particularly for reducing noise and increasing a compression efficiency by improving rotary type compression mechanisms.

In general, a rotary compressor of this kind is assembled to a refrigerating cycle provided for various types of refrigerating machines, refrigerators, air conditioners and the like. In such rotary compressor, a rotary type compression mechanism to be driven by an electric motor is accommodated in a sealed casing and a refrigerant compressed by the rotary type compression mechanism is discharged from a discharge chamber into the refrigerating cycle through the sealed casing.

The rotary type compression mechanism of a conventional rotary compressor has a cylinder molded through a casting process and a refrigerant sucked from the suction port of the cylinder which is compressed in the cylinder. The refrigerant compressed in the cylinder is discharged into a main muffler chamber or a sub-muffler chamber through a discharge chamber formed to a main bearing side or a sub-bearing side. The main muffler chamber and the sub-muffler chamber are formed by a bearing cover covering the main bearing and the sub-bearing.

The refrigerant discharged into the sub-muffler chamber is introduced into the main muffler chamber through a communication hole and then introduced into the sealed chamber from the main muffler chamber.

Since the conventional rotary compressor has a discharge chamber formed on the main bearing side or the sub-bearing side, it is difficult for the discharge chamber to ensure a sufficient volume. Furthermore, since a discharge passage formed to the main bearing and the sub-bearing is arranged as the discharge chamber accommodating a discharge valve, it is difficult to define a chamber space having a substantial volume. In addition, in the conventional rotary compressor, since a cutout for a discharge port must be formed to an end surface of the inner periphery of the cylinder, it is difficult to reduce a top clearance because of the existence of the cutout, which causes a problem in the improvement of compression efficiency and reduction of noise.

On the other hand, for example, Japanese Utility Model Laid-Open Publication No. SHO 62-20186 shows a prior art providing a rotary compressor which is molded through a casting process and has a discharge chamber formed in a cylinder. In the rotary compressor of this kind, a hole is defined in the cylinder in parallel with a cylinder bore by means of a drill or the like and is used as a discharge chamber, and a discharge valve called a curl valve is accommodated in the discharge chamber, which communicates with a cylinder bore through a discharge port.

In the conventional rotary compressor of the above structure, after the cylinder is molded by casting, a discharge port formed to the inner periphery of a cylinder bore is cut by a cutting tool so as to obtain a required inner peripheral shape of the cylinder bore.

In the conventional rotary compressor having a discharge port defined in the cylinder, after the cylinder is molded by casting, a hole is drilled to the cylinder in parallel with a cylinder bore as a discharge chamber and a curl valve is accommodated therein. In this case, however, it is difficult for the discharge chamber to be formed to have a large size, and the vicinity of the discharge port must be mechanically and physically strengthened because the cylinder is made by casting. Consequently, a sufficient wall thickness must be provided between a blade groove, and the discharge port by causing the discharge port (discharge hole) to be spaced apart from the blade groove, and also a certain degree of a volume must be secured to the discharge port. Thus, a problem arises in the improvement of a compression efficiency and the reduction of noise because it is difficult to reduce a top clearance and to increase the volume of the discharge chamber formed in the cylinder.

Furthermore, in a conventional rotary compressor having a discharge chamber formed by a hole drilled in the cylinder, there is provided a further problem of forming the discharge chamber to be covered in the height direction of the cylinder. In the conventional rotary compressor having a discharge chamber formed to a main bearing and a sub-bearing and a discharge valve disposed in the discharge chamber, it is difficult to assemble the discharge valve because a sufficient volume cannot be ensured to the discharge chamber, and it is also difficult to sufficiently reduce noise resulting from the operation of the rotary compressor because a refrigerant is discharged into a sealed casing without sufficiently damping the pressure pulsation of the refrigerant.

Further, in the conventional rotary compressor, since a suction port defined to the cylinder is machined to a circular shape, the suction port has a large width of opening in the rotational direction (rolling direction) of a roller piston, thus the start of compression effected by a roller piston being delayed, and there is a possibility that a compression efficiency is reduced accordingly.

SUMMARY OF THE INVENTION

A primary object of the present invention is to substantially eliminate defects or drawbacks encountered in the prior art described above and to provide a rotary compressor capable of improving a compression efficiency by reducing a top clearance and reducing noise by securing a sufficient volume of a discharge chamber in a cylinder of a rotary type compression mechanism.

Another object of the present invention is to provide a rotary compressor capable of reducing noise and vibration resulting from a pulsation of a refrigerant caused when it is discharged through a discharge chamber having a sufficient volume to thereby efficiently reduce the transmission of the noise and vibration to the outside.

A further object of the present invention is to provide a rotary compressor having a discharge chamber formed by assembling a valve sheet in the cylinder in the casting process so that the discharge chamber requires no post-machining process.

A still further object of the present invention is to provide a rotary compressor suitable for mass-production and capable of improving coupling strength between a valve sheet and a cylinder casting and stabilizing the coupling therebetween by molding a valve-sheet-assembled type cylinder through a casting process.

A still further object of the present invention is to provide a rotary compressor capable of causing a discharge valve to be simply and easily assembled by securing a sufficient volume to a discharge chamber formed in the cylinder as well as sufficiently reducing noise by damping the pressure pulsation of a discharged refrigerant.

A yet still further object of the present invention is to provide a rotary compressor capable of improving a compression efficiency by setting the compression start point of a roller piston at an earlier timing.

A still further object of the present invention is to provide a less expensive rotary compressor suitable for the mass-production which has versatility achieved by standardizing the shape of the cylinder.

The above and other objects can be achieved according to the present invention by providing, in one aspect, a rotary compressor comprising:

an outer casing;

a rotary type compression mechanism accommodated in the outer casing in a sealed manner; and an electric motor for driving the rotary type compression mechanism, the rotary type compression mechanism being provided with a cylinder having an inner peripheral surface to which a discharge port is formed, the inner peripheral surface of the cylinder having a portion composed of a valve sheet to which the discharge port is formed.

In preferred embodiments, the valve sheet is formed of a steel sheet. The cylinder is formed as a valve-sheet-assembled-type cylinder integrally molded together with the valve sheet through a casting process. The valve sheet is formed of a steel sheet having a thickness of about 0.5–3 mm.

The steel sheet forming the valve sheet contains Ni in an amount of 3 wt % or more, or the steel sheet forming the valve sheet has an outer surface plated with Ni. The steel sheet forming the valve sheet may be a stainless steel sheet containing Cr in an amount of 10 wt % or more.

The cylinder is formed with a blade groove which extends outwardly in a radial direction of the cylinder and the valve sheet is bent to provide a substantially L-shape on the blade groove side thereof so that the L-shaped bent portion constitutes a portion of a groove side wall of the blade groove.

A boundary surface is formed so as to extend outwardly of the inner peripheral surface of the cylinder from a boundary between a casting constituting the inner peripheral surface of the cylinder and the portion of the valve sheet opposite to the blade groove and the boundary surface is across a circumscribed surface of the inner peripheral surface of the cylinder passing through the boundary at a predetermined angle.

The cylinder is formed with a discharge chamber formed on a discharge side of the discharge port and a discharge valve mechanism covering the discharge port is accommodated in the discharge chamber. The discharge chamber formed in the cylinder has a discharge chamber outlet hole formed to at least one side thereof substantially in parallel with an axial line of the cylinder.

The compression mechanism is formed with a main muffler chamber and a sub-muffler chamber formed by covering a main bearing and a sub-bearing with a bearing cover, respectively, and the discharge chamber of the cylinder is communicated with the sub-muffler chamber through the discharge chamber outlet hole, said sub-muffler chamber being communicated with the main muffler chamber through a communication hole and the main muffler chamber being communicated with the casing.

In another aspect, there is provided a rotary compressor comprising:

an outer casing;

rotary type compression mechanism accommodated in the outer casing in a sealed manner; and an electric motor for driving the rotary type compression mechanism, the rotary type compression mechanism being provided with a cylinder having an inner peripheral surface to which a discharge port is formed, the cylinder being formed with a discharge chamber formed outwardly of the discharge port in a radial direction of the cylinder integrally with the cylinder and the discharge port is closed by a chamber cover which covers the discharge chamber from an outside of the cylinder.

In preferred embodiments, the inner peripheral surface of the cylinder has a portion composed of a valve sheet to which the discharge port is formed. The chamber cover may be formed of a vibration damping steel sheet. The chamber cover is formed of a casting material which is mainly composed of flake graphite containing graphite particles each having a size larger than that of a casting material constituting the cylinder.

An elastic seal means is disposed to a portion at which the chamber cover is in contact with the cylinder and the chamber cover is fixed to the cylinder by using an elastic press means. The elastic press means may be a leaf spring.

In a further aspect of the present invention, there is provided a rotary compressor comprising:

an outer casing;

a rotary type compression mechanism accommodated in the casing in a sealed manner; and an electric motor for driving the rotary type compression mechanism, the rotary compression mechanism being provided with a cylinder in which a roller piston is accommodated and being formed with suction port, the suction port being formed on the inner peripheral surface side of the cylinder and at least an edge of the suction port located downstream of a rotational direction of the roller piston is formed to provide a linear shape substantially in parallel with the axial line of a rotational shaft of the motor.

The inner peripheral surface of the cylinder has a portion composed of a valve sheet to which the discharge port is formed.

The suction port formed to the cylinder is formed to provide a circular shape so as to match with a shape of a suction pipe on the outer peripheral side of the cylinder and to provide a fine rectangular shape in the axial direction of the rotational shaft on the inner peripheral side of the cylinder.

In a still further aspect of the present invention, there is provided a rotary compressor comprising:

an outer casing;

two rotary type compression mechanisms accommodated in the outer casing in a sealed manner; and electric motor means for driving the rotary compression mechanisms, the two rotary type compression mechanisms being assembled integrally together with a partition means interposed therebetween and each of the compression mechanisms having a cylinder provided with a main muffler chamber and a sub-muffler chamber formed by covering a main bearing and a sub-bearing with a bearing cover, the cylinders being formed with discharge chambers so that the discharge chambers are communicated with each other through a communication hole, at least the discharge chamber of the cylinder on the side of the sub-bearing being communicated with the sub-muffler chamber through a discharge chamber outlet hole, the sub-muffler chamber being communicated with the main muffler chamber through a communication hole, and the main muffler chamber being communicated with the outer casing.

According to the present invention of the various aspect described above, mainly, since a portion of the inner peripheral surface of the cylinder is composed of a valve sheet and the discharge port is defined to the valve sheet, a volume of the discharge port can be reduced, so that a compression efficiency can be improved by reducing a top clearance.

According to the various preferred embodiments of the present invention, the following functions and effects will be achieved.

Since a valve-sheet-assembled-type cylinder is integrally molded together with the valve sheet composed of the steel sheet and assembled in a mold in casting, a valve-sheet-assembled-type cylinder having a high coupling strength can be realized by integrally assembling the valve sheet to the cylinder through the casting of the cylinder. The thus obtained valve-sheet-assembled-type cylinder is not only coupled by the high coupling strength but also has excellent productivity and is suitable for the mass-production.

Since the valve sheet is composed of the steel sheet having a thickness of about 0.5 mm–3 mm, the valve sheet can be made thin, so that a volume of the portion of the discharge port can be reduced and a top clearance can be reduced, thus a compression efficiency being improved, different from a discharge port formed by a casting.

Since the valve sheet may be composed of a steel sheet containing Ni in an amount of 3 wt % or more or a steel sheet whose surface is plated with Ni, excellent intimacy and intimate contact property can be obtained by a Ni component melted out from the valve sheet in the casting process, so that the valve sheet can be integrally coupled with the cylinder casting and the coupling force between the cylinder casting and the valve sheet can be improved, thus providing a valve-sheet-assembled-type cylinder with a high strength suitable for the mass-production.

Since the valve sheet may be composed of a stainless steel sheet containing Cr in an amount of 10 wt % or more, the valve sheet has a large heat resistant strength and deformation resistant strength and is subject to a very small deformation in casting, so that a valve-sheet-assembled-type cylinder suitable for the mass-production can be made with high accuracy.

Since the cylinder is formed with a blade groove which extends outwardly in a radial direction of the cylinder, the valve sheet is bent to a substantially L-shape on the blade groove side thereof and the L-shaped bent portion constitutes a portion of the groove side wall of the blade groove, the discharge port formed to the valve sheet can be caused to approach to the blade groove side, so that the top clearance can be reduced to improve a pressure efficiency. Further, only a portion of the groove side wall of the blade groove to which a small blade sliding load is applied is composed of the valve sheet and the groove side wall to which a large blade sliding load is applied can be composed of a casting material having an excellent wear resistance, so that the performance of the compressor can be improved without lowering the sliding performance and reliability of the blade.

Since there is formed a boundary surface extending outwardly from the boundary between a casting constituting the inner peripheral surface of the cylinder and the portion of the valve sheet opposite to the blade groove, and the boundary surface is across the circumscribed surface of the inner peripheral surface of the cylinder passing through the boundary at a predetermined angle, an angle of a casting at the crossing can be set to a large value, so that a coupling strength of the casting and the valve sheet in the vicinity of the boundary is improved and the coupling is stabilized by effectively and securely prevent the lack of the casting, thus providing a valve-sheet-assembled-type cylinder having excellent quality.

Since the discharge chamber formed in the cylinder is formed to the outside of the discharge port of the valve sheet and the discharge chamber is partitioned by the thin valve sheet, the discharge chamber having a large volume can be formed, and since the discharge chamber is formed of the valve sheet in casting, any post-machining process is not required to form the discharge chamber, thus forming the rotary compressor economically.

Since the discharge chamber having a large volume is formed in the cylinder and the discharge chamber outlet hole is defined to the discharge chamber substantially in parallel with the axial line of the cylinder, the discharge chamber outlet hole can be easily and simply formed, and the cylinder is standardized with versatility, so that a valve-sheet-assembled-type cylinder suitable for the mass-production can be economically provided.

Since the discharge chamber having a large volume is formed in the cylinder and a compressed refrigerant discharged into the discharge chamber is guided into the sealed casing sequentially passing through the sub-muffler chamber and the main muffler chamber, noise is reduced and pressure pulsation is made smooth through a multi-stage muffler action, so that the transmission of noise and vibration resulting from the pressure pulsation of the discharged refrigerant to the outside of the sealed casing can be effectively prevented.

Since the cylinder has the discharge chamber integrally formed therewith outwardly of the discharge port in a radial direction, and the discharge chamber is covered with and closed by the chamber cover from the outside of the cylinder, the discharge chamber can be provided with a sufficient volume and the discharge valve can be easily assembled. Further, the pressure pulsation of a discharged refrigerant can be damped in the discharge chamber having the sufficient volume, so that noise resulting from the operation of the compressor can be greatly reduced.

Since the discharge chamber is provided with a sufficient volume to thereby damp the pressure pulsation of a discharged refrigerant and reduce noise resulting from the operation of the compressor and a portion of the inner peripheral surface of the cylinder is composed of the valve sheet and the discharge port is formed to the valve sheet, a volume of the discharge port and the top clearance are reduced, so that a pressure efficiency can be improved.

Since the chamber cover covering the discharge chamber is formed of a vibration damping steel sheet or a casting material which is mainly composed of flake graphite containing large graphite particles, noise and vibration resulting from the pressure pulsation of a discharged refrigerant is greatly damped while passing through the chamber cover composed of the vibration damping steel sheet, so that the noise and the vibration can be reduced.

Since the elastic seal means is disposed to the portion where the chamber cover is in contact with the cylinder and the chamber cover is fixed to the cylinder through the elastic means, the chamber cover can be mounted to the cylinder by one touch of a finger and the leakage of a discharged refrigerant from the chamber cover can be surely prevented even if the chamber cover is mounted by one touch of a finger.

Since at least the edge of a suction port, which opens to the inner peripheral surface side of the cylinder, located downstream of the rotation directional, i.e. rolling direction, of the roller piston is formed to a linear shape substantially in parallel with the axial line of a rotational shaft, a point at which compression is started by the roller piston can be set at an earlier timing, so that a compression efficiency can be improved accordingly.

Since a point at which compression is started by the roller piston can be set at an earlier timing, a portion of the inner peripheral surface of the cylinder is composed of the valve sheet and the discharge port is formed to the valve sheet, a volume of the discharge port and the top clearance are reduced and a pressure efficiency can be more effectively improved.

Since the suction port of the cylinder is formed to provide a circular shape so as to match with the pipe shape of a suction pipe on the outer peripheral side of the cylinder and to provide a fine rectangular shape in the axial direction of the rotary shaft on the inner peripheral side of the cylinder, respectively, a compression start point can be set at an earlier timing while the connection of the suction pipe is arranged similarly to that of a conventional one, so that a compression efficiency can be improved.

Since the discharge chambers are formed to both the cylinders of two rotary type compression mechanisms, respectively, and the discharge chambers of both the cylinders are connected to each other, the cylinders can be approximately or entirely formed to the same shape, so that the cylinders can be standardized with versatility, thus realizing a less expensive rotary compressor suitable for the mass-production.

The nature and the further features of the present invention will be made more clear through the following description made with reference to the accompanying drawings.

DESCRIPTION OF THE PREFERRED EMBODIMENTS

Embodiments of a rotary compressor according to the present invention will be described hereunder with reference to the accompanying drawings.

Figure 1:
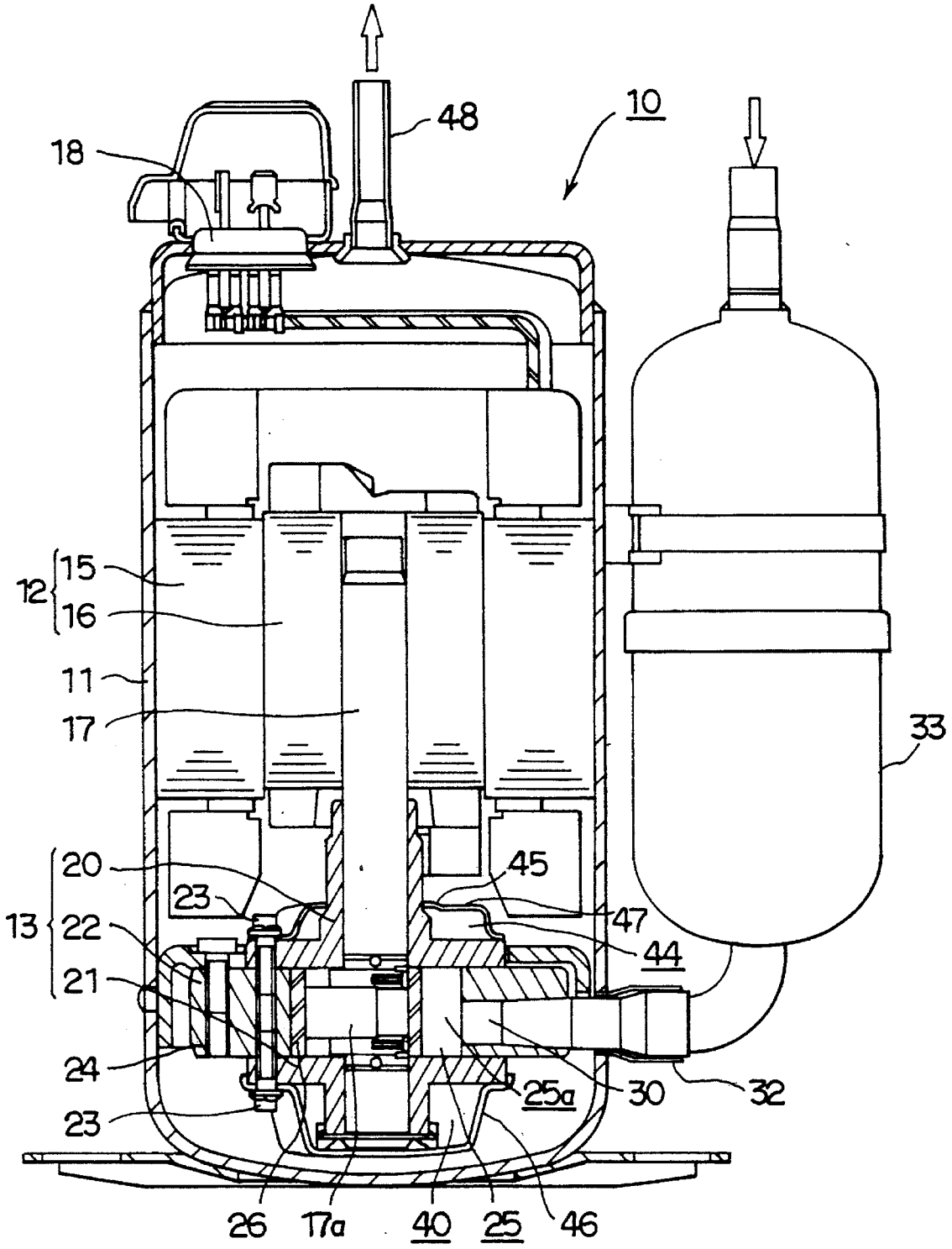
FIG. 1 is a longitudinal sectional view showing a first embodiment of a rotary compressor according to the present invention.

FIG. 1 is a longitudinal sectional view showing a first embodiment of a rotary compressor according to the present invention. The rotary compressor of FIG. 1 is one which is assembled to a refrigerating cycle installed to a refrigerating machine such as refrigerated show case, refrigerator, air conditioner and the like.

Referring to FIG. 1, a rotary compressor 10 is arranged as a vertical type compressor, an electric motor 12 is accommodated in the upper portion of a sealed casing 11 as a compressor case and a rotary type compression mechanism 13 to be driven by the motor 12 is accommodated in the lower portion of the casing 11, respectively. The motor 12 is composed of a stator 15 force-fitted into the sealed casing 11 and fixed therein and a rotor 16 accommodated in the stator 15. The rotor 16 is coupled with a rotational shaft 17 as an output shaft and rotatably supported thereby. The motor 12 has a power supply terminal 18 connected to a power supply source and driven in rotation by being energized through the terminal 18.

The rotational shaft 17 supporting the rotor 16 of the motor 12 is rotatably supported by the main bearing 20 and the sub-bearing 21 of the rotary type compression mechanism 13. The main bearing 20 and the sub-bearing 21 are disposed to hold a cast cylinder (cylinder block) 22 from opposite sides thereof and integrally assembled therewith by a fixture such as tightening bolts 23 or the like. The cylinder 22 is fixed to and supported by the sealed casing 11 through a support frame 24. On the other hand, the support frame 24 is force-fitted into the sealed casing 11 and fixed thereto through a welding process or the like.

Figure 2:
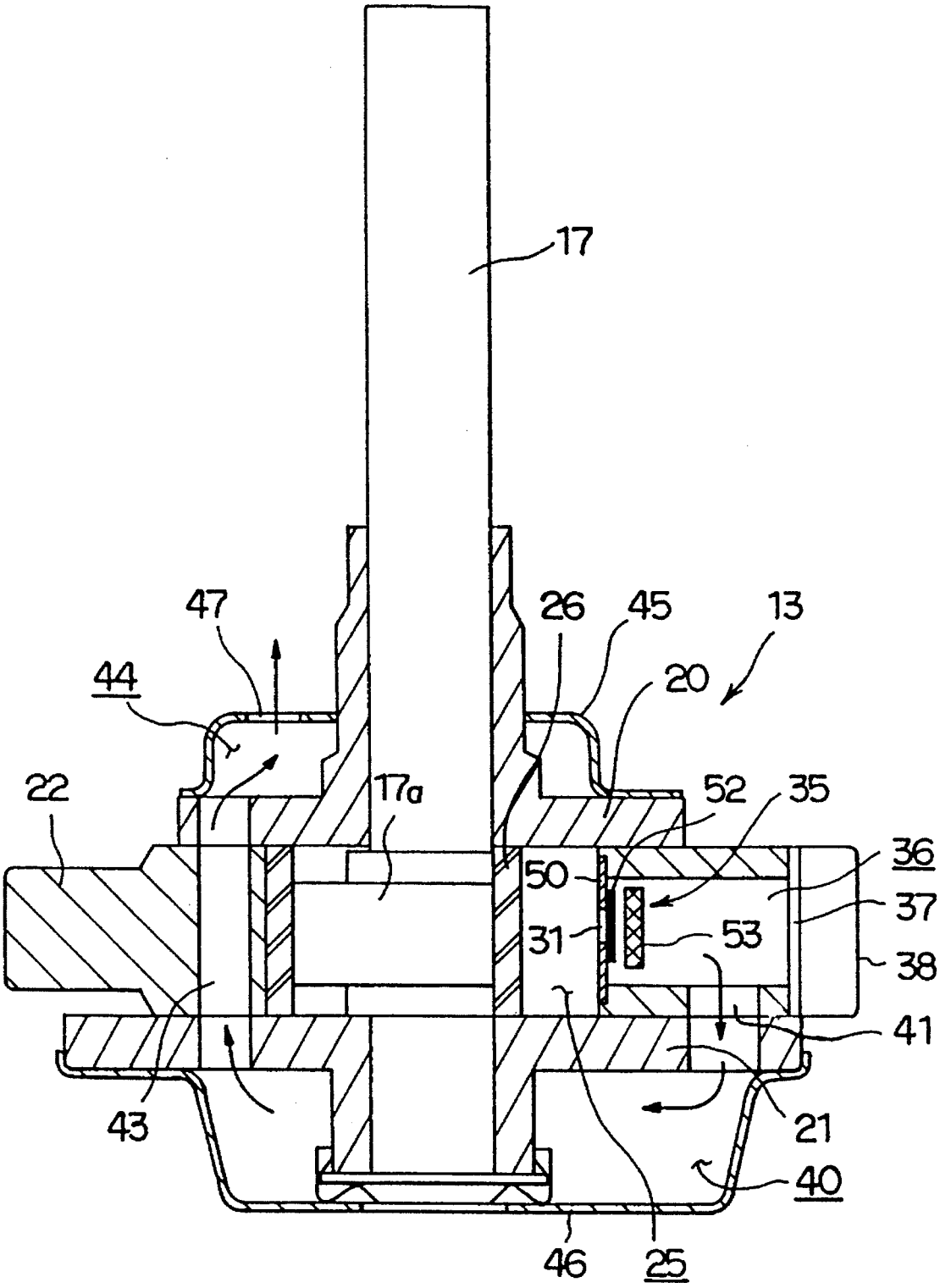
FIG. 2 is a cross sectional view showing a rotary type compression mechanism assembled to the rotary compressor of FIG. 1.
Figure 3:
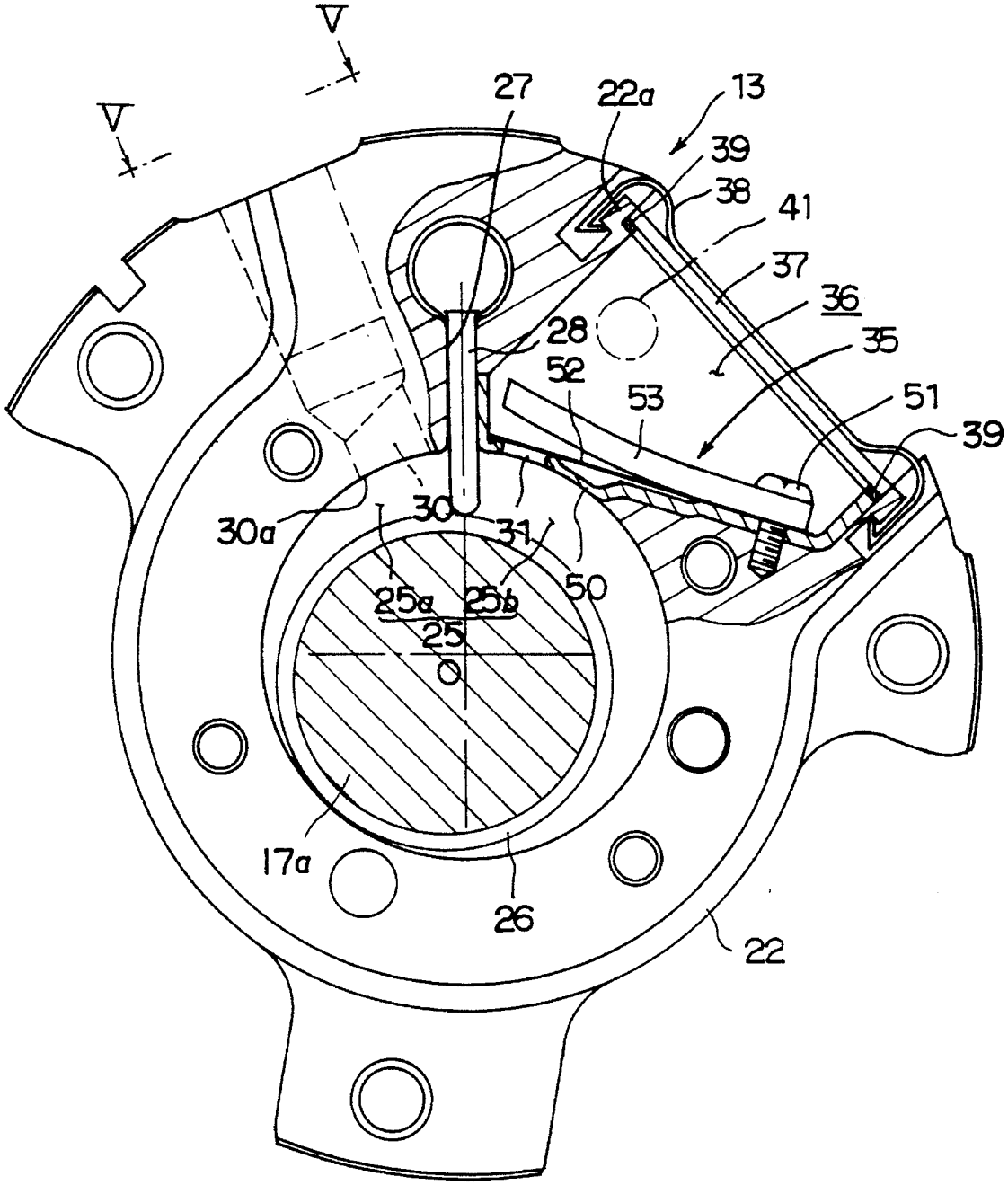
FIG. 3 is a plan view showing a valve-sheet-assembled-type cylinder mounted on the rotary type compression mechanism of FIG. 2.

As shown in FIG. 1 to FIG. 3, a cylinder chamber 25 is formed in the cylinder 22 of the rotary type compression mechanism 13 by being partitioned by a cylinder bore, and a roller piston 26 is accommodated in the cylinder chamber 25. The roller piston 26 is coupled with the crank unit 17*a* of the rotational shaft 17 and eccentrically rotated while rolling in the cylinder chamber 25 when the rotational shaft 17 rotates so as to perform a compressing action.

Figure 4:
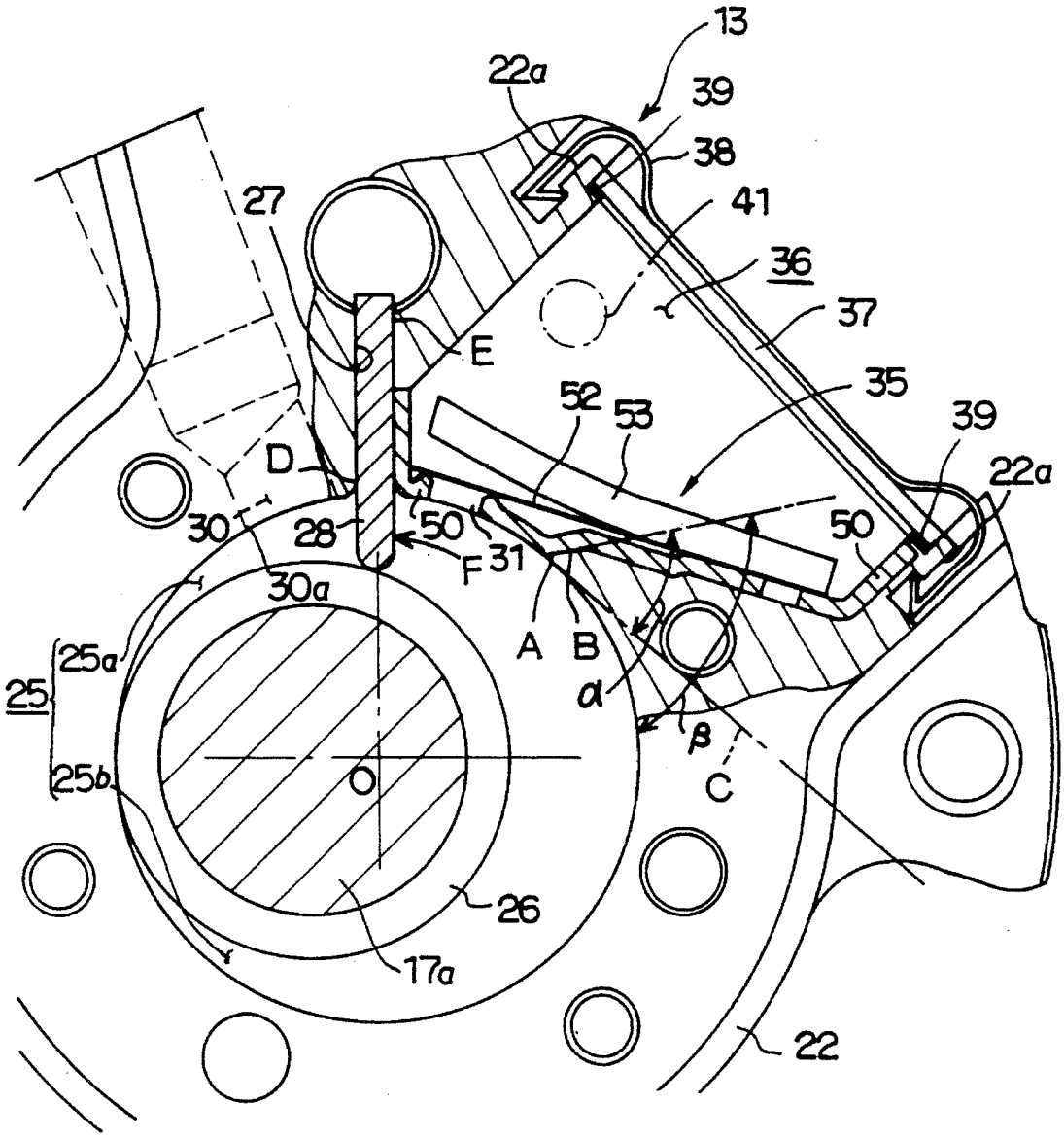
FIG. 4 is an enlarged view of the rotary compression mechanism shown in FIG. 3 for the explanatory of the relationship of action of a force.

As shown in FIG. 3, the rotary type compression mechanism 13 has a blade groove 27 which extends outwardly in a radial direction from the inner peripheral surface of the cylinder bore (inner peripheral surface of the cylinder) and accommodates a blade 28 shown in FIG. 3 and FIG. 4 in a manner that the blade 28 is urged by a spring so as to press the roller piston 26. The interior of the cylinder chamber 25 is partitioned to a suction side chamber 25*a* and a compression side chamber 25*b* by the blade 28. A suction port 30 and a discharge port 31 are defined on both the sides of the blade groove 27 in the cylinder 22, respectively.

As shown in FIG. 1, the suction port 30 is connected to an accumulator 33 through a suction pipe 32 and a gas refrigerant composed of a gas separated from a liquid in the accumulator 33 is sucked into the suction side chamber 25*a* of the cylinder chamber 25.

Figure 5:
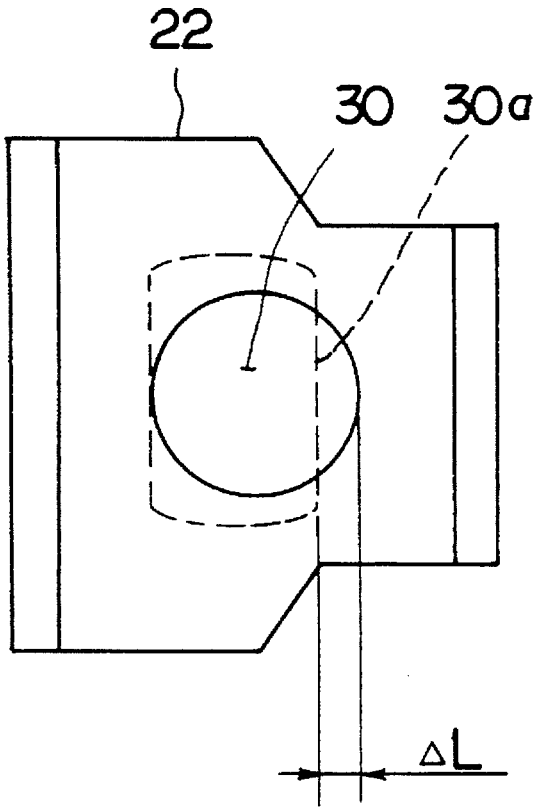
FIG. 5 is a partial side elevational view taken along the line V—V of FIG. 3.

As shown in FIG. 5, the suction port 30 formed in the cylinder 22 in a radial direction is formed to a circular shape so as to match with the pipe shape of the suction pipe 32 on the outer peripheral side of the cylinder 22 and to a fine rectangular shape in the axial direction of the roller piston 26 on the inner peripheral side of the cylinder 22. In particular, the suction port 30 opening to the inner peripheral surface of the cylinder 22 permits the roller piston 26 to start compression at an earlier timing by ΔL in such a manner that at least the edge 30*a* of the suction port 30 located downstream in the rotational direction of the roller piston 26 is linearly formed substantially in parallel with the axial line of the rotational shaft 17.

Since the opening of the suction port 30 formed to the inner peripheral side of the cylinder 22 is formed to the rectangular shape, a point at which compression is started by the roller piston 26 can be set nearer to the blade 28 side and the compression can be started at an earlier timing so that a compression efficiency can be improved accordingly as compared with a conventional circular suction port, even if the same cross sectional area is employed for suction.

The discharge port 31 communicates with a discharge chamber 36 through a discharge valve mechanism 35 such as a reed valve and discharges a refrigerant compressed in the compression side chamber 25*b* of the cylinder chamber 25. As shown in FIG. 2 and FIG. 3, the discharge chamber 36 is partitioned in the cylinder 22. Although the discharge chamber 36 has an opening at the peripheral side thereof, the opening is closed by a chamber cover 37. The chamber cover 37 may be mounted by one touch of a finger from the outer peripheral side of the cylinder 22 by an elastic press means 38 such as a plate leaf spring, coil spring or the like and hooked to the locking claw 22*a* of the cylinder 22.

The discharge chamber 36 is formed to have a large volume from the discharge port 31 of the cylinder 22 outwardly in a radial direction. An elastic seal means 39 is disposed from the outside of the cylinder 22 to the portion where the chamber cover 37 covering the discharge chamber 36 is in contact with the cylinder 22. The seal means 39 is composed of a seal member such as an elastic packing, rubber material or the like. The seal means 39 may be previously mounted on at least one of the chamber cover 37 and the cylinder 22.

The chamber cover 37 is composed of a material having large damping characteristics to noise and vibration such as, for example, a vibration damping steel plate. The chamber cover 37 may be composed of a casting material mainly containing flake graphite having graphite particles whose size is larger than that of a casting material constituting the cylinder. Noise and vibration resulting from the pressure pulsation of a refrigerant discharged from the discharge chamber 36 are absorbed and greatly damped when they pass through the chamber cover by such an arrangement that the chamber cover 37 is composed of the vibration damping steel plate or the casting plate mainly containing flake graphite. Damping characteristics for damping or attenuating the noise and vibration are greatly improved by the chamber cover 37 which is mounted to cover the opening of the discharge chamber 36 of the cylinder 22 through the elastic seal means 39, so that the noise and vibration caused by the operation of the rotary compressor can be further reduced.

A discharge chamber outlet hole 41 is drilled to the discharge chamber 36 of the cylinder 22 and communicates with a sub-muffler chamber 40 which communicates with a main muffler chamber 44 through a communication hole 43 defined to the cylinder 22. The discharge chamber outlet hole 41 and the communication hole 43 are drilled to the cylinder 22 so that they are substantially in parallel with the axial line of the cylinder 22. On the other hand, the main muffler chamber 44 and the sub-muffler chamber 40 are partitioned by bearing covers 45 and 46 which are mounted on the main bearing 20 and the sub-bearing 21 from the outside, respectively. The respective bearing covers 45 and 46 are tightened to the main bearing 20 and the sub-bearing 21 by means of the tightening bolts 23 and fixed thereto.

The main muffler chamber 44 communicates with the interior of the sealed casing 11 through a port 47 defined to the main bearing 20. With this arrangement, a refrigerant compressed in the cylinder chamber 25 is discharged into the discharge chamber 36 through the discharge valve mechanism 35 from the discharge port 31. Next, the discharged refrigerant is sequentially guided to the sub-muffler chamber 40 and the main muffler chamber 44 through the discharge port outlet hole 41 so as to be subjected to a multi-stage muffler action, so that the pressure pulsation of the refrigerant is made smooth. Then, the refrigerant is guided into the sealed casing 11 and discharged to the outside through a discharge pipe 48 installed at the top of the sealed casing 11.

Incidentally, the cylinder 22, the main bearing 20 and the sub-bearing 21 which constitute the rotary type compression mechanism 13 is molded by casting a casting material. Among them, the cylinder 22 is molded by casting together with a valve sheet 50 which was previously formed and assembled in a casting mold, so that the cylinder casting and the valve sheet 50 are integrally coupled in contact with each other. At the time, the valve sheet 50 is assembled in the casting mold so as to constitute a portion of the inner peripheral surface of the cylinder 22 (inner peripheral surface of the cylinder bore) and integrally cast to manufacture the valve-sheet-assembled-type cylinder 22 as shown in FIG. 3.

The valve sheet 50 is formed of a thin steel sheet having a thickness of about 0.5–3 mm. The discharge port 31 is formed to the valve sheet 50. The steel sheet constituting the valve sheet 50 contains a Ni component in an amount of 3 wt % or more.

When the valve-sheet-assembled-type cylinder 22 is molded, the cylinder casting is cast at the temperature of molten metal of, for example, about 1450° C. However, since the Ni component is contained in the valve sheet 50, the Ni component in the valve sheet 50 is melted in casting and fused with the cylinder casting so that the valve sheet 50 can be integrally coupled with the cylinder casting. As a result, the portion where the cylinder casting is joined to the valve sheet 50 is integrated so that they are coupled with each other with a high strength. Therefore, a mechanical and physical strength can be improved, thus a valve-sheet-assembled-type cylinder suitable for the mass-production can be manufactured.

On the other hand, the surface of the valve sheet 50 may be plated with Ni in place of that it contains Ni in the amount of 3 wt % or more. Since the Ni component is also melted out and fused when the cylinder casting is cast together with the valve sheet 50 assembled thereto, the cylinder casting is integrated with the valve sheet 50.

On the other hand, a stainless steel sheet having a melting point of about 1890° C. and containing Cr in an amount of 10 wt % or more may be used for the valve sheet 50. Since thermal deformation of the valve sheet 50 can be greatly reduced in casting by the use of the stainless steel sheet for the valve sheet 50, the valve sheet 50 can be assembled with high accuracy and integrated and the valve-sheet-assembled-type cylinder can be accurately manufactured, thus this type of the valve-sheet-assembled-type cylinder being suitable for mass-production.

Further, the valve-sheet-assembled-type cylinder 22 is arranged as shown in FIG. 3 and the valve sheet 50 is assembled integrally with the cylinder 22. At the time, the valve sheet 50 is bent to substantially an L-shape on the blade groove 27 side thereof and the L-shaped bent portion constitutes a portion of the groove side wall of the blade groove 27. Although the extreme end of the L-shaped bent portion of the valve sheet 50 terminates at some point in midway through the blade groove 27, the blade groove 27 is partitioned from the discharge chamber 36 by the valve sheet 50. Since the discharge chamber 36 can be partitioned from the blade groove 27 by the valve sheet 50 having a large strength, the discharge port 31 can be caused to greatly approach the blade 28 side shown in FIG. 4. Even if the discharge port 31 approaches the blade 28 side, the mechanical and physical strength of the cylinder 22 is not injured. Therefore, a top clearance can be reduced in cooperation with the thin wall structure of the valve sheet 50, thus improving the compression efficiency.

Since the discharge port 31 of the cylinder 22 is formed in the valve sheet 50, the volume of the portion of the discharge port for forming the top clearance can be reduced as compared with a case that the discharge port is formed to the casting portion of the cylinder 22 as in a conventional rotary compressor. Therefore, the compression efficiency can be greatly improved as compared with the conventional rotary compressor. For example, the compression efficiency can be improved 10% or more as compared with a rotary compressor of the same type in terms of a coefficient of performance (COP) usually used in rotary compressors.

Since the valve-sheet-assembled-type cylinder 22 includes the valve sheet 50 which is assembled to constitute a portion of the inner peripheral surface of the cylinder and the discharge chamber 36 is formed to the discharge side (outside in a radial direction of the cylinder) of the valve sheet 50, a volume of the discharge chamber 36 formed in the cylinder 22 can be increased. The discharge chamber 36 opens to the outer periphery side of the cylinder 22 and the discharge valve mechanism 35 is inserted through the opening and accommodated in the discharge chamber 36 and fixed thereto by a fixture such as fixing screws 51.

A check valve such as, for example, a reed valve is used to the discharge valve mechanism 35 and the reed valve fixes a valve plate 52 which covers the discharge port 31 in such a manner that it can be opened and closed and also covers a valve guide 53 which guides the opening/closing of the valve plate 52 by co-tightening them. Since the discharge valve mechanism 35 can be assembled to the valve sheet 50 by means of screws or the like in a state that the chamber cover 37 for the discharge chamber 36 having a large volume is removed, the discharge valve mechanism 35 can be simply and easily assembled.

The opening side of the discharge chamber 36 is covered with and closed by the chamber cover 37, whereas the chamber cover 37 is attached to and held by the locking claw **22*a* of the cylinder 22 by the elastic press means 38 such as the leaf spring or the like by one touch of a finger. Further, the discharge chamber outlet hole 41 is drilled to the discharge chamber 36 substantially in parallel with the axial line of the cylinder, and the discharge chamber 36 communicates with the sub-muffler chamber 40 through the discharge chamber outlet hole 41. Since the discharge chamber 36 is formed to the cylinder 22 when it is cast, the discharge chamber 36 need not be formed through a post-machining process. Further, since the discharge chamber 36 is formed in casting, the discharge chamber outlet hole 41 can be easily drilled because of the existence of the discharge chamber 36**.

As described above, the discharge chamber 36 with a large volume is formed in the valve-sheet-assembled-type cylinder 22 on the discharge side of the valve sheet 50 and the discharge chamber 36 is formed to a substantially sealed structure except the discharge chamber outlet hole 41. Therefore, noise resulting from the pressure pulsation of a compressed refrigerant produced in the discharge chamber 36 can be sealed by the muffler action of the discharge chamber 36, thus the transmission of noise and vibration to the outside of the rotary compressor 10 can be effectively prevented. A rotary compressor of the same type can reduce a noise level to 3 dB or more as compared with a conventional compressor.

As shown in FIG. 3 and FIG. 4, the valve sheet 50 on the opposite side of the blade groove 27 is bent from the midway thereof in a direction apart from the inner peripheral surface of the cylinder in the valve-sheet-assembled-type cylinder 22. That is, a boundary surface B is obliquely extended so that it is directed outwardly of the inner peripheral surface of the cylinder from a boundary A between the cylinder casting on the inner peripheral surface of the cylinder and the valve sheet 50, and the boundary surface B is across the circumscribed surface C of the inner peripheral surface of the cylinder passing through the boundary A at a predetermined angle $\alpha$ for example, at an acute angle. With this arrangement, an angle $\beta$ of the cylinder casting can be set to a large value at the crossing, so that a coupling strength of the cylinder casting with the valve sheet 50 can be improved in the vicinity of the boundary A to stabilize coupling and, thus, the lack of the cylinder casting can be prevented. Consequently, a valve-sheet-assembled-type cylinder having excellent quality can be provided.

Further, as shown in FIG. 4, the top clearance of the portion of the discharge port can be reduced by such an arrangement that the cylinder 22 is cast together with the valve sheet 50 which was previously assembled thereto and the discharge port 31 is formed in the valve sheet 50 to constitute a portion of the inner peripheral surface of the cylinder. When the rotary compressor 10 is operated, a pressure in the cylinder chamber 25 is gradually increased in the compression side chamber **25*a* by the rotation of the roller piston 26, and the blade 28 receives an action force F in an arrow direction on the side thereof from the compression side chamber 25*b*. The force F acting on the blade 28 is mainly supported by the two points D and E on the sliding surface in the blade groove 27**.

At the time, the sliding surface of the blade groove 27 which receives the action force F from the blade 28 is formed of a casting material excellent in wear resistance and the L-shaped bent portion of the valve sheet 50 does not receive the action force F from the blade 28. Thus, the performance of the compressor can be improved without lowering the reliability of the valve-sheet-assembled-type cylinder 22, i.e., the rotary compressor 10.

Since the rotary compressor 10 is provided with the valve-sheet-assembled-type cylinder 22 which is cast together with the valve sheet assembled to the rotary type compression mechanism 13, a refrigerant compressed in the cylinder chamber 25 of the compression mechanism 13 is discharged from the discharge port 31 into the discharge chamber 36 through the discharge valve mechanism 35 and subjected to a muffler action, so that the pressure pulsation of the refrigerant is reduced.

Next, the refrigerant discharged into the discharge chamber 36 is guided into the sub-muffler chamber 40 through the discharge chamber outlet hole 41, thereafter guided into the main muffler 44 thorough the communication hole 43 and then discharged into the sealed casing 11 from main muffler chamber 44. The discharged refrigerant is subjected to a multi-stage muffler action in the respective muffler chambers 40 and 44 so that the pressure pulsation of the discharged refrigerant is made uniform and smoothed and a pressure of the refrigerant discharged at high pressure is made uniform in the sealed casing 11. The refrigerant discharged into the sealed casing 11 is discharged to the outside of a refrigerating cycle or the like from a discharge pipe 55 in a state that the pressure pulsation of the refrigerant is removed and the pressure thereof is made uniform.

Figure 6:
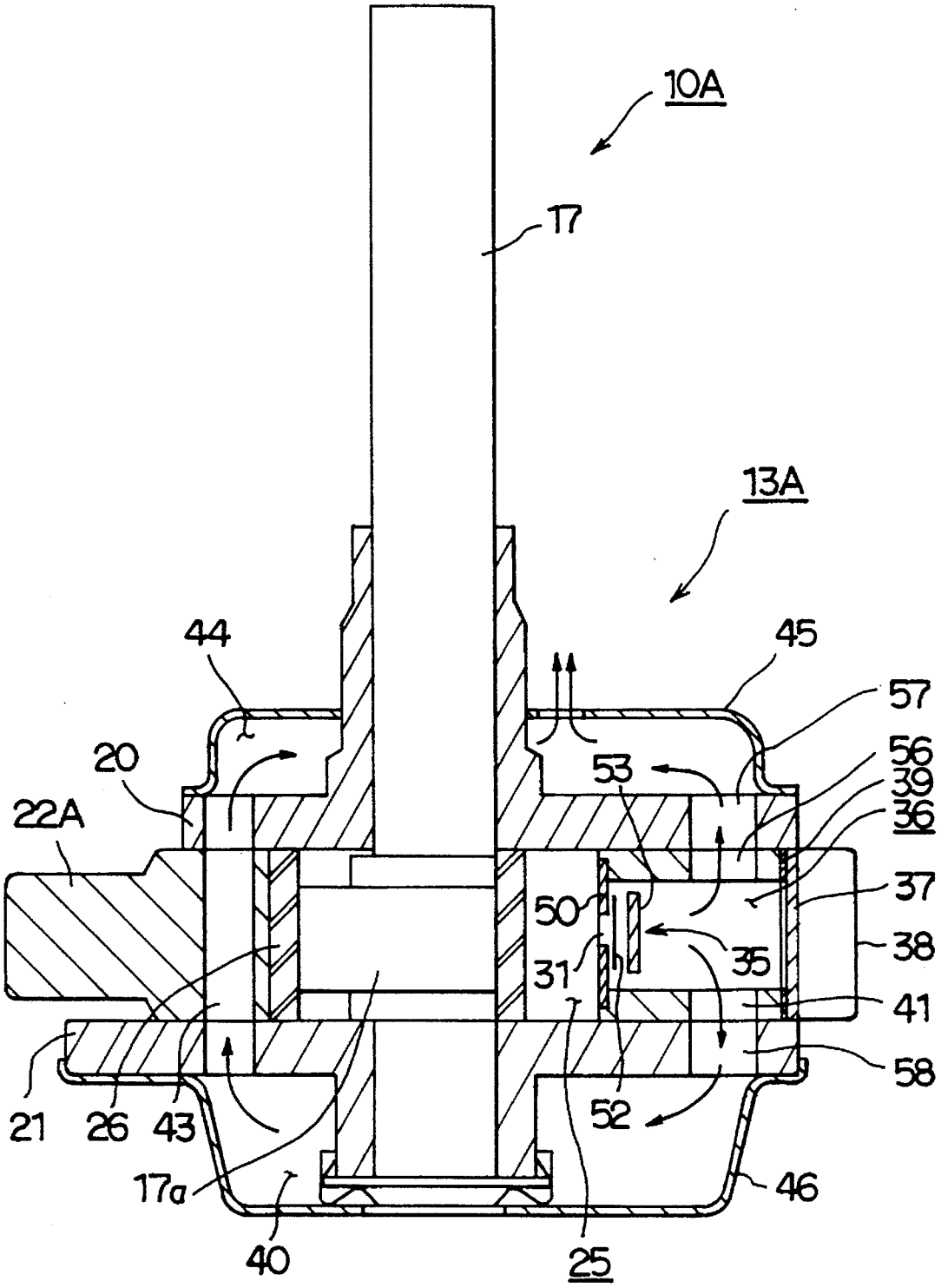
FIG. 6 shows a second embodiment of a rotary compressor according to the present invention with a cross sectional view of a rotary type compression mechanism.

FIG. 6 shows a second embodiment of a rotary compressor 10A according to the present invention. The rotary compressor 10A of the embodiment is arranged by providing versatility with the cylinder 22A of a rotary type compression mechanism 13A and the other arrangement thereof is the same as that shown in the first embodiment. Thus, the same numerals are used to denote the same parts and the description thereof is omitted.

The cylinder 22A assembled to the rotary type compression mechanism 13A shown in FIG. 6 is the same as that of the first embodiment in that the compression mechanism comprises a valve-sheet-assembled-type cylinder which is cast together with a valve sheet 50 assembled thereto. In the cylinder 22A, however, after the valve-sheet-assembled-type cylinder 22A is molded through the casting process together with the valve sheet 50 assembled thereto, the discharge chamber outlet holes 41 and 56 are defined by means of a drill or the like so that they pass through the discharge chamber 36 of the cylinder 22A in parallel to the axial line of the cylinder. Since the holes 41 and 56 are defined to pass through the discharge chamber 36, they can be easily machined.

The discharge chamber outlet ports 41 and 56 are defined on both the sides of the discharge chamber 36 formed in the cylinder 22 and caused to communicate with a main muffler chamber 44 and a sub-muffler chamber 40, respectively through communication ports 57 and 58 formed to bearings 45 and 46. At the time, the diameters of the discharge chamber outlet holes 41 and 56 formed on both the sides of the discharge chamber 36 may be changed so that, for example, the diameter of the output hole 56 on the upper side is made smaller than that of the outlet hole 41 on the lower side.

In this case, a high pressure refrigerant discharged into the discharge chamber 36 from the cylinder chamber 25 of the rotary type compression mechanism 13A through a discharge port 31 and a discharge valve mechanism 35 is introduced into the main muffler chamber 44 and the sub-muffler chamber 40 through the upper and lower discharge chamber outlet holes 56 and 41 while the pressure pulsation of the refrigerant is eased in the discharge chamber 36 having a large volume and subjected to a muffler action, respectively, so that the pressure pulsation is made smooth and the noise is lowered.

The refrigerant introduced into the sub-muffler chamber 40 is guided into the main muffler 44 through a communication hole 43, joins to the refrigerant having passed through the upper discharge chamber outlet hole 56 in the main muffler chamber 44 and then is introduced into a sealed casing 11.

Figure 7:
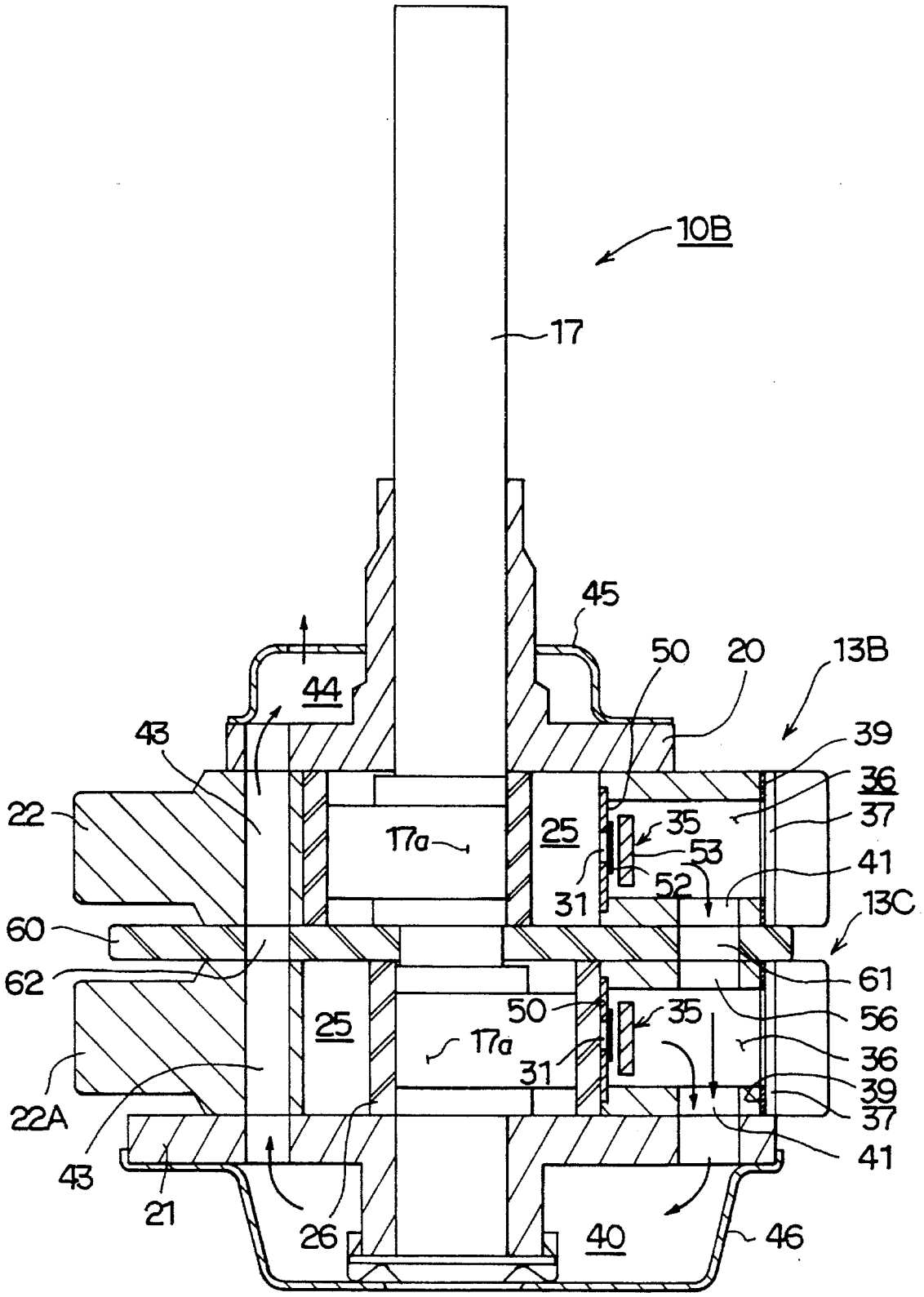
FIG. 7 is a third embodiment of a rotary compressor according to the present invention with a cross sectional view of a rotary type compression mechanism arranged as a twin rotary type mechanism.

FIG. 7 shows a third embodiment of a rotary compressor according to the present invention.

The rotary compressor 10B of the third embodiment is a twin rotary compressor in which two rotary type compression mechanisms 13B and 13C are assembled. A partition plate 60 is interposed between the cylinders 22 of both the rotary type compression mechanisms 13B and 13C and the upper cylinder 22 is in intimate contact with the lower cylinder 22A through the partition plate 60 held therebetween. An outlet port 61 and a communication port 62 are defined to the partition plate 60, respectively.

According to this third embodiment, the valve-sheet-assembled-type cylinder shown in FIG. 2 to FIG. 4 is used for the cylinder of the upper rotary type compression mechanism 13B and the valve-sheet-assembled-type cylinder 22A shown in FIG. 6 is used for the lower rotary type compression mechanism 13C. That is, the upper cylinder 22 is provided with a single discharge chamber outlet hole 41 and the lower cylinder 22 is provided with two discharge chamber outlet holes 56 and 41, respectively.

In this case, standard cylinder parts can be commonly used only by changing the post-machining process to valve-sheet-assembled-type cylinders having the same dimension and configuration which were cast together with a valve sheet 50 previously assembled thereto. That is, the upper cylinder 22 or the lower cylinder 22A can be made only by selecting whether a single discharge chamber outlet hole is to be drilled or two discharge chamber outlet holes are to be drilled as a vertical through hole to the valve-sheet-assembled-type cylinder molded by casting. At the time, drilling of the discharge chamber outlet hole can be easily effected because the discharge chamber having a large volume is integrally molded by assembling the valve sheet 50 in the cylinder 22.

Although the rotary compressor of this third embodiment is provided with two sets of compressors, since the operation thereof is substantially the same as that of the first embodiment, description of the operation is now omitted.

Figure 8:
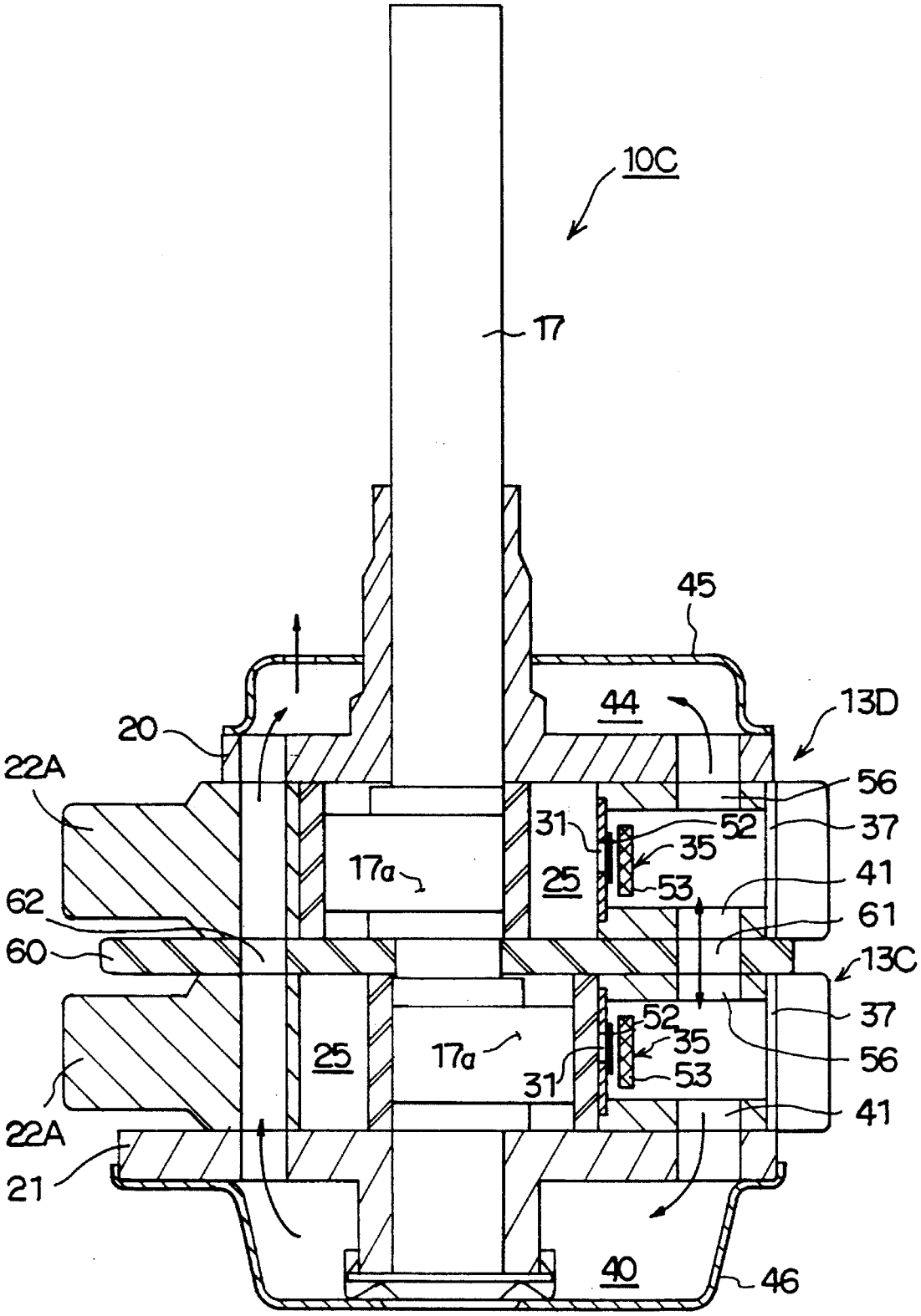
FIG. 8 is a fourth embodiment of a rotary compressor according to the present invention with a cross sectional view of a rotary type compression mechanism arranged as a twin rotary type mechanism.

FIG. 8 shows a fourth embodiment of a rotary compressor according to the present invention.

The rotary compressor 10C of this fourth embodiment is also a twin type rotary compressor into which two rotary type compression mechanisms 13D and 13C are assembled, similarly to the one shown in FIG. 7. The rotary compressor 10C employs the valve-sheet-assembled-type cylinder shown in FIG. 6 as cylinders 22A, 22A provided with both the rotary type compression mechanisms 13D and 13C and defines two discharge chamber outlet holes 56 and 41 to the cylinders, respectively. That is, the valve-sheet-assembled-type cylinder shown in FIG. 6 is employed as both the upper cylinder and the lower cylinder and a partition 60 is interposed between both the cylinders 22A, 22A.

Since the rotary compressor 10C is also provided with two sets of the compressors and has operation substantially similar to that of the second embodiment, the description of the operation is now omitted.

Although FIG. 7 and FIG. 8 describe the embodiments provided with the twin type rotary compressor, they need not always be provided with two sets of the compressors but may be provided with three sets or more of them. Further, a rotary compressor provided with three sets of rotary type compression mechanisms may be arranged as a multi-compression structure. For example, a first stage compressor may be composed of a rotary type compression mechanism at the center and second stage compressors may be composed of upper and lower rotary type compression mechanisms. In this case, a refrigerant compressed by the rotary type compression mechanism at the center and discharged into a discharge chamber is introduced into the suction sides of the upper and lower rotary type compression mechanisms.

Further, although the respective embodiments of the present invention are described with reference to examples of vertical type compressors, they may be arranged as horizontal type rotary compressors.

In this and other connection, it is to be noted that the present invention is not limited to the described embodiments and many other changes or modifications may be made without departing from the scopes of the appended claims.

What is claimed is:

1. A rotary compressor comprising:

an outer casing;

a rotary compression mechanism accommodated in the outer casing in a sealed manner;

an electric motor for driving the rotary compression mechanism, said rotary compression mechanism being provided with a cylinder having an inner peripheral surface in which a discharge port is formed; and said inner peripheral surface of the cylinder having a portion formed of a valve sheet in which said discharge port is formed, said cylinder being formed with a blade groove which extends outwardly in a radial direction of the cylinder, and said valve sheet being bent to provide a substantially L-shape on the blade groove side thereof so that the L-shaped bent portion constitutes a portion of a groove side wall of said blade groove.

2. A rotary compressor according to claim 1, wherein said valve sheet is formed of a steel sheet.

3. A rotary compressor according to claim 2, wherein said cylinder is formed as a valve-sheet-assembled-type cylinder integrally molded together with said valve sheet through a casting process.

4. A rotary compressor according to claim 2, wherein said valve sheet is formed of a steel sheet having a thickness of 0.5–3 mm.

5. A rotary compressor according to claim 3, wherein said steel sheet forming the valve sheet contains Ni in an amount of 3 wt % or more.

6. A rotary compressor according to claim 3, wherein said steel sheet forming the valve sheet has an outer surface plated with Ni.

7. A rotary compressor according to claim 3, wherein said steel sheet forming the valve sheet is a stainless steel sheet containing Cr in an amount of 10 wt % or more.

8. A rotary compressor according to claim 1, wherein a boundary surface is formed so as to extend outwardly of the inner peripheral surface of the cylinder from a boundary between a casting constituting the inner peripheral surface of the cylinder and the portion of said valve sheet opposite to said blade groove and said boundary surface is across a circumscribed surface of the inner peripheral surface of the cylinder passing through said boundary at a predetermined angle.

9. A rotary compressor according to claim 1, wherein said cylinder is formed with a discharge chamber formed on a discharge side of the discharge port and a discharge valve mechanism covering said discharge port is accommodated in the discharge chamber.

10. A rotary compressor according to claim 9, wherein said discharge chamber formed in said cylinder has a discharge chamber outlet hole formed to at least one side thereof substantially in parallel with an axial line of the cylinder.

11. A rotary compressor according to claim 9, wherein said compression mechanism is formed with a main muffler chamber and a sub-muffler chamber formed by covering a main bearing and a sub-bearing with a bearing cover, respectively, and the discharge chamber of said cylinder is communicated with said sub-muffler chamber through the discharge chamber outlet hole, said sub-muffler chamber being communicated with said main muffler chamber through a communication hole and said main muffler chamber being communicated with the casing.

12. A rotary compressor comprising:

an outer casing;

a rotary compression mechanism accommodated in the outer casing in a sealed manner;

an electric motor for driving the rotary compression mechanism, said rotary compression mechanism being provided with a cylinder having an inner peripheral surface in which a discharge port is formed;

a leaf spring; and said cylinder being formed with a discharge chamber formed outwardly of said discharge port in a radial direction of the cylinder integrally with the cylinder and said discharge chamber being closed by a chamber cover which covers said discharge chamber from an outside of the cylinder, and wherein an elastic seal means is disposed to a portion at which said chamber cover is in contact with said cylinder and said chamber cover is fixed to said cylinder by said leaf spring.

13. A rotary compressor according to claim 12, wherein said inner peripheral surface of the cylinder has a portion composed of a valve sheet to which said discharge port is formed.

14. A rotary compressor according to claim 12, wherein said chamber cover is formed of a vibration damping steel sheet.

15. A rotary compressor according to claim 12, wherein said chamber cover is formed of a casting material which is mainly composed of flake graphite containing graphite particles each having a size larger than that of a casting material constituting the cylinder.

16. A rotary compressor comprising:

an outer casing;

a rotary compression mechanism accommodated in the outer casing in a sealed manner;

an electric motor for driving the rotary compression mechanism, said rotary compression mechanism being provided with a cylinder, in which a roller piston is accommodated and being formed with a suction port, said cylinder having an inner peripheral surface in which a discharge port is formed;

said inner peripheral surface of the cylinder having a portion formed of a valve sheet in which said discharge port is formed, said cylinder being formed with a blade groove which extends outwardly in a radial direction of the cylinder, said valve sheet being bent to provide a substantially L-shape on the blade groove side thereof so that the L-shaped bent portion constitutes a portion of a groove side wall of said blade groove; and said suction port being formed on the inner peripheral surface side of the cylinder and at least an edge of the suction port located downstream of a rotational direction of said roller piston is formed to provide a linear shape substantially in parallel with the axial line of a rotational shaft of the motor.

17. A rotary compressor according to claim 16, wherein said suction port formed to the cylinder is formed to provide a circular shape so as to match with a shape of a suction pipe on the outer peripheral side of said cylinder and to provide a fine rectangular shape in the axial direction of the rotational shaft on the inner peripheral side of the cylinder.

* * * * *